United States Patent [19]

Steffensen

[11] Patent Number: 4,545,539

[45] Date of Patent: Oct. 8, 1985

[54] CUTTING MILL FOR THE COMMINUTION OF SYNTHETIC MATERIAL BODIES SUCH AS RUNNERS, INJECTION MOULDING PARTS, BLOWN MOULDING PARTS AND THE LIKE

[76] Inventor: Bjarne T. Steffensen, Odensevej 22, 5690 Tommerup, Denmark

[21] Appl. No.: 613,760

[22] Filed: May 24, 1984

Related U.S. Application Data

[63] Continuation of Ser. No. 372,811, Apr. 28, 1982, abandoned.

[30] Foreign Application Priority Data

May 7, 1981 [DK] Denmark ..... 2024/81
Jan. 15, 1982 [DE] Fed. Rep. of Germany ..... 3201096

[51] Int. Cl.[4] ..... B02C 13/02
[52] U.S. Cl. ..... 241/73; 241/160; 241/222; 241/242; 241/243
[58] Field of Search ..... 241/73, 158, 160, 190, 241/222–225, 242, 243, 294

[56] References Cited

U.S. PATENT DOCUMENTS

| | | | |
|---|---|---|---|
| 305,711 | 9/1884 | Phillips | 241/158 |
| 2,544,072 | 3/1951 | Dutra, Jr. | 241/190 |
| 4,000,860 | 1/1977 | Gotham | 241/294 X |
| 4,061,284 | 12/1977 | Raisbule et al. | 241/294 |
| 4,106,708 | 8/1978 | Kropa | 241/294 X |
| 4,151,960 | 5/1979 | Peterson, Jr. | 241/73 |
| 4,176,800 | 12/1979 | Brewer | 241/294 X |

FOREIGN PATENT DOCUMENTS

| | | |
|---|---|---|
| 1168222 | 12/1960 | Fed. Rep. of Germany . |
| 2216640 | 4/1972 | Fed. Rep. of Germany . |
| 2309400 | 2/1973 | Fed. Rep. of Germany . |

*Primary Examiner*—Howard N. Goldberg
*Assistant Examiner*—Timothy V. Eley
*Attorney, Agent, or Firm*—Bernard, Rothwell & Brown

[57] ABSTRACT

The invention relates to a cutting mill for the comminution of runners, injection moulding parts, blown moulding parts and so forth in operation of a synthetic material processing machine. Waste or reject parts becoming available should, if possible, be led back again to the process cycle of the machine after comminution to granulated size for use as a regenerate. For this purpose one makes use of a cutting mill having a cylindrical driven rotor mounted in a housing, over the periphery of which rotor a plurality of adjacently positioned cutting element groups are arranged, which cooperate with at least one stationary blade provided in the housing, wherein a sieve for filtering of the comminuted material extends over a part of the boundary of the rotor. The cutting mill provides an additional means for gripping and precomminution in front of the stationary blade, considered in the input direction, and is characterized in that the rotor rotates with a relatively low rotational speed of below 500 Rpm, preferably approximately 100 Rpm. The additional means is preferably constructed from a cylindrical carrier with guide surfaces and a plurality of guide plates preferably equally spaced along the length of the housing, wherein these guide plates preferably lie in planes at right angles to the axis of the rotor.

14 Claims, 6 Drawing Figures

CUTTING MILL FOR THE COMMINUTION OF SYNTHETIC MATERIAL BODIES SUCH AS RUNNERS, INJECTION MOULDING PARTS, BLOWN MOULDING PARTS AND THE LIKE

This is a continuation of application Ser. No. 372,811 filed Apr. 28, 1982, now abandoned.

The invention relates to a cutting mill for the comminution of synthetic material bodies as runners, injection moulding parts, blown moulding parts and the like. A known cutting mill comprises: a cylindrical driven rotor positioned in a housing, over the periphery of which rotor a plurality of cutting element groups are arranged in mutually staggered relationship, which cutting element groups cooperate with at least one stationary blade provided in the housing; and a sieve extending over a part of the periphery of the rotor for the filtering of milled material.

Cutting mills of such a construction are known, for example from German Offenlegungsschrift No. 22 16 640. This publication describes a cutting mill rotor in the form of a rotating roller for the comminution of large compact pieces of synthetic material. In this case, the rotor carries groups of knives having blades with parallel axes, wherein these knives are distributed along the length of the rotor in a plurality of groups and the axially adjacent groups are mutually staggered in the peripheral direction, in order in operation of the cutting mill to allow individual cutting knives on the cutting mill rotor to come into engagement with the stationary blade in each case sequentially.

The known cutting mill operates usually with a rotational speed between approximately 1000 and 1500 revolutions per minute. For the comminution of large compact pieces of synthetic material, such cutting speeds are acceptable. For the comminution of runners and injection moulding parts such high cutting speeds are unfavorable, since the less compact variously shaped material of off-cuts from injection moulding machines springs back, holds back from the cutting entrance, and jumps out again from the cutting aperture, so that protective covers must be provided above the cutting mill in order to catch the material, for noise suppression, and also for the avoidance of an undesired formation of dust.

Therefore, one must provide the cutting mills of the prior art for comminution of runners additionally with the said protective devices, as a result of which their constructional height becomes greater. With the progressive development of synthetic material extrusion technology, and in the setting of automation of the operation of injection moulding machines, it was desired as far as possible to convey runners accumulating during each cycle without manual intervention for reuse in the inject moulding machine after corresponding comminution.

In the area of automation of the injection moulding machine for quantity production of mass produced components, there is therefore the requirement to reprocess accumulating runners immediately. This reprocessing then takes place in such manner that the runners are so comminuted, that is so reduced in size, that they approximately correspond in their grain size with the general granulate and are mixed together with the granulate as a regenerated material as required. With certain injection moulding parts, the regenerated portion can form a high percentage of the total amount of synthetic material fed to the injection moulding machine.

With the known cutting mills for the treatment of runners, one proceeded earlier in such a way that the runners were conveyed from the place of their production laterally to the cutting mill by means of a large screw conveyor or by means of a type of sloping elevator, which picked up the runner and transported it upwards, where it could be fed into the laterally arranged cutting mill. There are also already known pneumatic arrangements for the conveyance of the runners into the region of the cutting mill. The use of compressed air leads, however, in undesirable manner, to dust production which, as already mentioned, is unavoidable during the processing of runners with fast-running cutting mills.

The described devices for the comminution or runners of injection moulding machines for their re-use as a regenerated substance in the injection cycles, produce the described disadvantages of a relatively large noise and dust production. It is possible to counter these disadvantages simply by means of corresponding isolation of the housing, dust covers and the like. The constructional height of the known cutting mills is as a result so large that sometimes their desired accommodation beneath an injection moulding machine cannot be achieved, since the space available there (approx. 500 to 600 mm) is in most cases insufficient to place the cutting mills in this position.

It is therefore the aim of the invention to avoid the described disadvantages and, starting from a cutting mill of the type described in the introduction, to provide an arrangement which displays a relatively small noise and dust production in operation, which can be arranged beneath a normal injection moulding machine, and serves efficiently for the comminution of runners injection moulding parts, and also blown moulding parts which should be conveyed for reprocessing as regenerated substance.

According to the invention, there are provided means for gripping and precomminution before the stationary blade in the entry direction and drive means for driving the rotor with a rotational speed of below 500 Rpm. Owing to the fact that one allows the cylindrical cutting blade rotor to rotate with a relatively low rotational speed, the problem of undesired noise and dust production is overcome in a simple manner. The essential improvement according to the invention of the already known cutting mills for the stated purpose consists, however, in the additional means for gripping and precomminution before drawing in the runners and injection moulding parts to the stationary blade. The gripping and precomminution means extend peripherally over a portion of the rotor from a region in the proximity of the edge of the stationary blade. Preferably, this means consists of laminar elements (sometimes referred to as lamellas or plates) which are arranged orthogonal to the axis of the cutting blade rotor in the housing. The plates have generally curved lower input or entry edges or surfaces which extend peripherally over a portion of the rotor and lie slightly outside the path of the cutting edges of the rotor. The generally curved lower input edges may have various configurations, e.g., smooth or toothed, depending upon the material to comminuted. and extend from the proximity of the edge of the stationary blade a substantial distance over the rotor. The lower input edges are generally arcuately disposed with respect to the path of the cutting edges of the rotor, but need not lie exactly concentrically with the axis of the rotor. For example, the lower input edges may converge towards the rotor up to the cutting edge of the stationary blade, or may initially diverge away from the rotor and then converge towards the rotor up to the stationary blade. These plates provide by means of their arrangement for an even effective drawing-in of the runners and injection moulding parts in the region of the stationary blade. The lamellas are preferably mutually equidistant and provided in a number which corresponds approximately to the number of adjacent cutting blade arrangements lying on the cylindrical rotor. The number of lamellas of the drawing-in arrangement can, however, also be somewhat less. The angular position of the lamellas, which for example lie orthogonal to the axis of the rotor, can also be arranged obliquely thereto in order better to prevent the comminuted parts from being fed backwards.

For the comminution of injection moulding parts which are particularly difficult to grasp, such as substanded blown moulding parts and the like, the input device can be provided with particular holding plates, for example having the form of a serration on the lower input edge of the plates. Such a serration can be replaced or supplemented by ribs, which are formed on a cylindrical rotor with the cutting blades themselves, in that for example the outer surface on the rotor is removed and replaced by ribs parallel to the axis. These ribs can of themselves or together with the serration on the leading edges of the lamellas work together with the input device and so ensure a particularly efficient comminution and/or conveyance of the hollow bodies into the region of the stationary blade of the cutting mill.

In dependence upon the material which is preferably to be comminuted, the curved shape of the lamellas of the input device can be differently shaped: in general one tries to provide a tapering gap against rotor up to the stationary blade, so that the guide-in lamellas from beginning of the input region gently spring back and move back against the housing. One can, however, so arrange these input elements that in the region of the first interaction between the material to be comminuted and the tool a more or less sharp-edged configuration of the lamellas is provided, through which is produced already here a preliminary comminution. In this way, by means of the sharp-edges, the gap in front of the stationary blade can converge. It can, however, also, to begin with, widen a little in order then to converge first in the region of the stationary blade.

Because of the relatively low rate of rotation of the driven rotor, it is possible from the rotor itself to take off the drive for a conveyor belt by means of which the injection moulding parts to be comminuted are transported from the place of their production to the housing inlet of the cutting mill. For this purpose, the axle of the rotor can have one of its ends extended along the rotor axis via the front side of the housing which is not shown at the front in FIG. 1, and can there carry a V-belt wheel for the direct drive of the said conveyor belt.

One obtains particularly dust free material to be milled with a cutting mill in which the sieve for separation of the material to be ground is provided with openings which open both towards the inner region, i.e. towards the cutting rotor, and to the outer region, i.e. towards the scrap holder in the housing.

Further details of the invention appear from the following description of the drawing. In the drawing, four exemplary embodiments of the invention are schematically illustrated.

Figure 1:
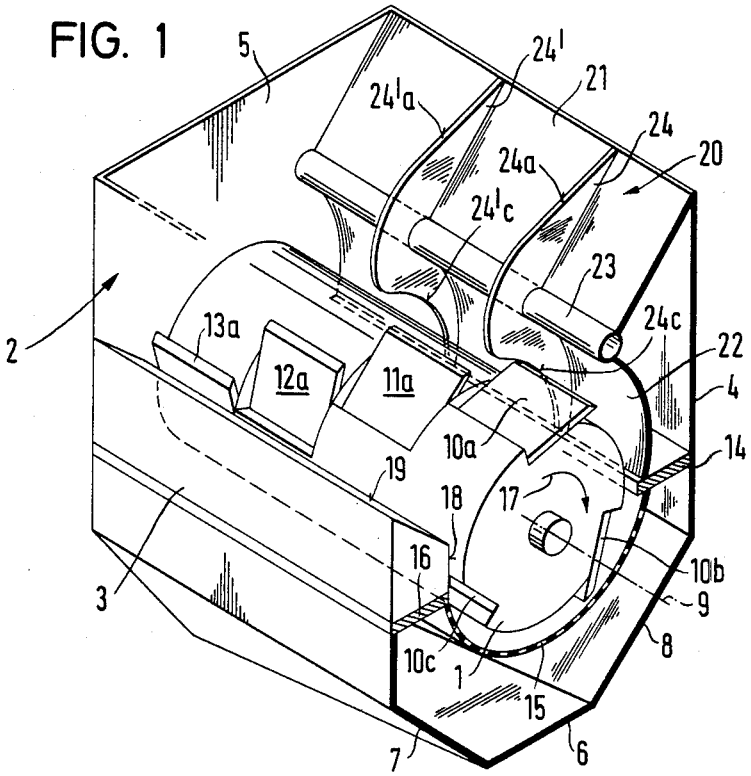
FIG. 1 shows a perspective representation of the new cutting mill, wherein for better understanding of the construction the front cover of the housing is cut away.

As one can recognize from the prespective view of the cutting mill shown in FIG. 1, the same consists of a cylindrical, driven rotor 1 which is mounted in the housing 2 in known manner. The housing, rectangular in cross section, consists of a front wall 3, a rearwall 4, a rear left side 5, a corresonding further front side, which for improved clarity is cut away, a flat sloping floor 6 with sloping side walls 7 and 8 as well as a cover which is in the form of a hopper or the like for guiding-in of the material to be comminuted, and which is not illustrated in the drawing. The cylindrical rotor is driven by a drive motor, also not illustrated in the drawing, for example beneath the gear change of a corresponding transmission, in order to achieve the desired low rate of rotation of about 100 Rpm. Also the mounting of the rotor is not shown. The rotor rotates about the axis 9 and is mounted in a corresponding mounting by the axle stubs shown in the drawing.

The rotor represented in FIG. 1 provides four cutting element groups 10, 11, 12 and 13. Each group consists of three cutting blades 10*a*, 10*b*, 10*c*, 11*a*, 11*b*, 11*c*, 12*a*, 12*b*, 12*c* and/or 13*a*, 13*b*, 13*c* which are equally distributed around the periphery of the rotor. As a result of the equidistant arrangement of cutting blades of a cutting element group and of the even angular spacing between neighboring groups there is produced, with the exemplary embodiment shown in FIGS. 1 and 2 of the cutting mill according to the invention, an angle displacement of 30° between the successive knife blades at their engagement with the stationary blade, as can be seen from FIG. 2. This angular displacement follows from the number of blades in a cutting element group multiplied by the number of element groups ($3\times4=12$, $360°:12=30°$). Should one increases the number of blades of the several cutting element groups to four and the cutting element groups from four to five, the angular distance between successive blades arriving at the stationary blade 14 in the cutting sequence, would be reduced from 30° to 18°.

The housing 2 is divided into two housing parts by means of the stationary blade 14 and the oppositely lying sieve carrying bar 16; a lower collection space 37, which is located beneath the sieve 15, is bounded by parts of the side walls 3, 4, 5, by the sloping floor 6, and by the also sloping side walls of the floor 7 and 8. In this collection space 37 is collected the material which has been comminuted and filtered through the openings 32 of the sieve 15 and which is carried out through an outlet which is not shown in the drawing. This outlet can be linked up with a mechanical, pneumatic or other suitable conveying device which carries the comminuted material to the intake and/or mixing device for the injection moulding machine.

The upper housing part is bounded by the rotor parts which extends above the plane of the stationary blade 14 and the sieve carrying bar 16, by the front side of the housing and by guide surfaces 18 and 19, as well as by the upper outwardly extending parts of the front wall 3 and rear guide surfaces 21 and 22, wherein the upper sloping guide surface, inclined towards the rear, guides the material to be comminuted to the rotor, and the lower cylindrical guide surface lies in the entry region of the material to be comminuted somewhat opposite the cylindrical surface of the rotor and is adapted correspondingly to the cylindrical shape. From this guide surface combination 21, 22, which is supported by a tubular carrier 23, guide plates 24, 24' extend outwardly and lie in planes orthogonal to the rotor axis 9.

An additional intake arrangement 20 for holding and precomminution before the stationary blade 14 in the entry direction is thus formed essentially from the tubular carrier 23, which supports the guide surfaces 21 and 22 and several guide plates 24, 24', preferably equally spaced along the length of the housing 2, wherein the guide plates preferably lie in planes at right angles to the rotor axis 9. They can, however, particularly in the middle region of the housing converge a little in the direction of the stationary knife 14, in order to prevent accumulation of the material to be comminuted in the lateral regions in the vicinity of the front wall 5 of the housing 2.

The number of guide plates 24, 24' is dependent upon type of injection moulding material to be comminuted, and upon the breadth of the several knife blades on the rotor 1, and is appropriately equal to or smaller than the number of adjacent lying blade groups on the rotor. In the preferred embodiments illustrated in FIG. 1 and 2, two guide plates 24, 24' stand opposite the four cutting element groups 10, 11, 12 and 13. If the rotor 1 is formed longer and is provided with five or six cutting element groups, the number of guide plates 24 can be higher than 3 or 4 in the illustrated embodiment. The essence of the arrangement 20 is the holding and precomminution of the sometimes very tough and bulky runners, which are guiding for comminution onto the stationary blade 14.

Figure 2:
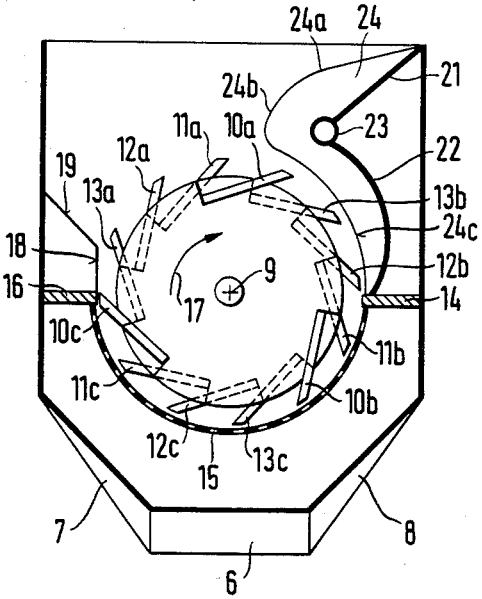
FIG. 2 shows a side view of the cutting mill according to FIG. 1 at the cut-away housing cover.
Figure 3:
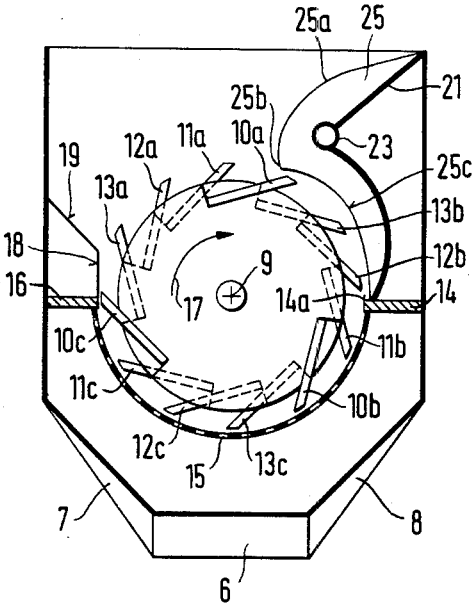
FIG. 3 shows the same representation as FIG. 2, however, with an intake plate modified from that shown in FIGS. 1 and 2.
Figure 5:
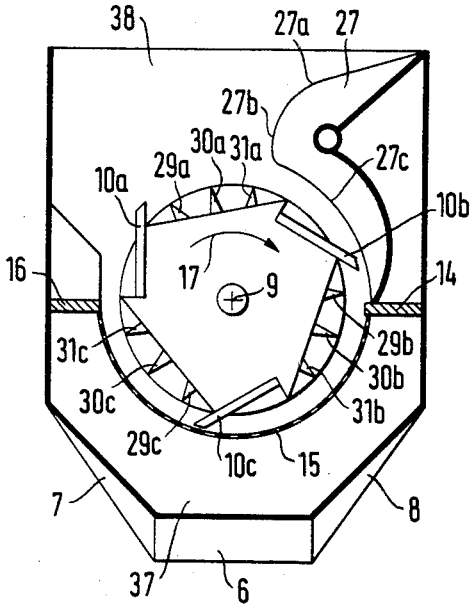
FIG. 5 shows the same view as FIGS. 2, 3 and 4, wherein the cutting rotor is provided with additional ribs and the intake plates have the same configuration as shown in the embodiment of FIGS. 1 and 2.

The guide plates 24, 24' extend from the upper edge of housing 2 and then run across a straight sloping downwardly-inclined region 24*a*, 24'*a*, and pass then via an inwardly inclined bend 24*b* and run finally in a concave arch along input edge 24*c*, 24'*c* which is adjacent the rotor, wherein the curved extent of the input edge 24*c*, 24'*c* is so shaped that it converges towards the rotor up to the cutting edge 14*a* of the stationary blade 14, as represented in FIG. 1 and 2, or perhaps first diverges and then converges, as represented by means of the curved shape of input edge 25*c* in the exemplary embodiment of FIG. 3 or is concentric to the rotor axis 9 as represented in the exemplary embodiment according to FIG. 5 by means of the curved shape of input edge 27*c*.

Figure 4:
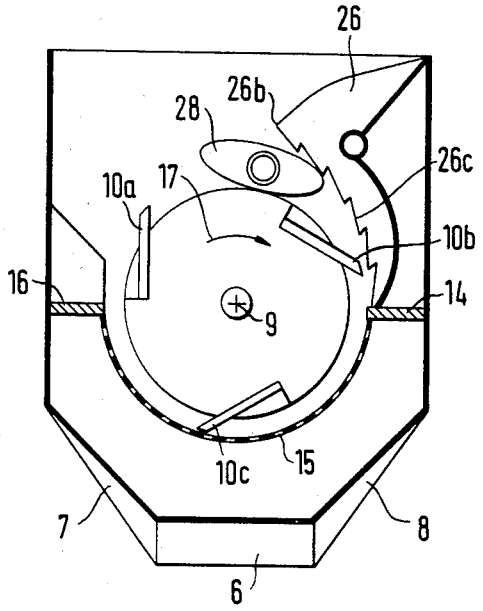
FIG. 4 shows the same view as FIGS. 2 and 3 of an exemplary embodiment of the cutting mill with toothed intake plates.

In the FIGS. 3, 4 and 5, further exemplary embodiments of the cutting mill according to the invention are represented, in which all the parts in FIGS. 3 and 4 except the guide plates are the same so that further explanation is unnecessary, and in FIG. 5 additionally the form of the rotor is modified.

The guide plates 25, in FIG. 3 differ from the guide plates of the exemplary embodiment according to FIG. 2 in that in the connection to the edge part 25 the guide plates include a sharp guide plate corner or tooth 25*b* which is particularly suitable for preliminary crushing of the material to be comminuted, if it projects in as far as the path of the blades of rotor 1, as far as the stationary blade 14 or in any case to a point close by the cutting part of the blades 10*a*, 10*b*, 10*c*. As already mentioned, the course of the further edges 25*c* is so formed that the space between the rotor and the edges first widens and then narrows again at the stationary blade 14.

For the comminution of hollow bodies, such as indicated by the hollow body 28, the embodiment of cutting mill according to FIG. 4 is particularly suitable. Here the guide plate 26, . . . as well as the input edge 26*c*, . . . are provided with a serration directed towards the edge 14*a* of the stationary blade 14 for increase of the holding force in the input direction. When the rotor 1 turns in the direction of the arrow 17, the hollow body 28 is pushed in by the following blade 10*a* as far as the gap between the toothed input edge 26*c* and the upper surface of the rotor 1, until the hollow body 28 is securely clamped in this region and subsequently comminuted to the required particle size as required for the reclaimed material by means of the following cutting edges of the blades 10*a*, 10*b*, 10*c*.

In the embodiment of FIG. 5, the cylinder of the rotor 1 is flattened between neighboring blades of every blade element group, and is provided with additional ribs 29, 30, 31. These ribs improve the conveying operation of the cylinder of the rotor in respect of the material to be comminuted against the stationary blade 14. The accompanying guide plates 27 extend from the upper edge of housing 2 and then run across a sloping downwardly-inclined region 27*a* and pass via an inwardly-inclined bend 27*b* and can, as illustrated in FIG. 5, be smooth, whereby the concave arched input edge 27*c* lying opposite the rotor can run concentrically to the axis 9. This input edge can, however, also, in the same manner as the input edge 24*c* which is spread outwardly in the exemplary embodiment according to FIG. 2, have the configuration of the exemplary embodiment accoding to FIG. 3 with edge 25*c* and a widening interior or, however, also the configuration according to FIG. 4 with an additional serrated input edge 26*c*.

By means of a simple test, one can, with the aid of the material coming to hand, optimize the guide plates in respect of the desired operation of the holding and comminution.

If required, the cutting mill according to the invention can also be so constructed that the guide plates 24, 25, 26 and 27 are arranged to be mutually inter-changeable, in that they are provided with corresponding recesses and/or guides and fix on to the tubular carrier, and push into corresponding deflecting plates 21 and 22 as well as corresponding guides on the back wall 4 and also in the stationary blade 14.

Figure 6:
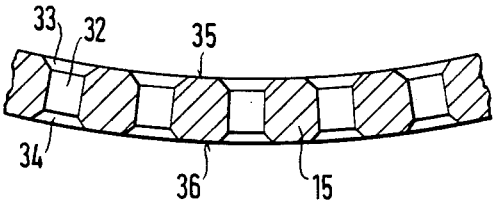
FIG. 6 shows a section through the sieve of the cutting mill according to the invention.

Expediently, one provided the sieve 15 both on the side 35 facing the rotor 1 and on the side 36 directed towards the collecting chamber 37 with widened portions 33, 34 for gripping, as is shown in FIG. 6.

I claim:

1. A cutting mill for the comminution of synthetic material bodies such as runners, injection moulding parts, blown moulding parts and the like comprising: a housing; a cylindrical rotor mounted for rotation in the housing; a plurality of mutually spaced cutting element groups arranged on the periphery of said rotor said cutting element groups comprising knives having knife edges substantially parallel with the axis of the rotor; at least one stationary blade, having a cutting edge substantially parallel with the axis of the rotor, and provided in the housing for cooperation with the knives of the cutting element groups; a sieve for filtering of the comminuted material extending over a part of the periphery of the rotor; means for gripping and precomminution of the material bodies before the stationary blade in an entry direction, said means including a plurality of guide plates, each guide plate having a narrow, generally curved lower input edge, each of the lower input edges extending from an area in proximity to the cutting edge of the stationary blade a substantialy distance along the periphery of the rotor and outside a peripheral path defined by the knife edges of the cutting elements of the rotor, the lower input edges being generally arcuately disposed with respect to the path defined by the knife edges of the cutting elements of the rotor, the guide plates being disposed substantially orthogonally to the knife edges and the axis of the rotor; and drive means for driving the rotor with a rotational speed of below 500 R.P.M.

2. A cutting mill according to claim 1, wherein said drive means is arranged to drive the rotor at a rotational speed of 100 R.P.M.

3. A cutting mill according to claim 1, wherein said rotor carries from three to five adjacent cutting element groups in the form of knife blades secured on the rotor, wherein each individual group consists of from 2 to 4 knife blades and neighboring cutting element groups are mutually staggered at an angle such that they provide an equidistant cutting sequence of the rotating knife blades in respect of the stationary blade.

4. A cutting mill according to claim 1, wherein said means for gripping and precomminution comprises a plurality of guide plates including said lower input edges.

5. A cutting mill according to claim 4, wherein at least one central pair of guide plates converges slightly in the direction of the stationary blade.

6. A cutting mill according to claim 4, wherein said guide plates are evenly distributed along the length of said housing.

7. A cutting mill according to claim 4 wherein said means for gripping and precomminution further comprises: a tubular carrier; and guide surfaces supported by said carrier.

8. A cutting mill according to claim 7 wherein said guide plates are supported by said carrier.

9. A cutting mill according to claim 4 wherein the number of guide plates is at most equal to the number of cutting element groups on the rotor.

10. A cutting mill according to claim 4 wherein said lower input edges of the guide plates are formed to converge towards the rotor up to the cutting edge of the stationary blade.

11. A cutting mill according to claim 4 wherein additionally an upper edge of each guide plate passes in the upper region of an edge of the housing first of all downwardly across a gently curving region, then forms a tooth with said lower input edge in the neighborhood of the cutting blade path, the lower input edge then entering a region where the distance between the lower input edge and the rotor initially widens and then narrows again up to the cutting edge of the stationary blade.

12. A cutting mill according to claim 4 for the comminution of blown moulding parts and the like, wherein said lower input edges are serrated adjacent the rotor, wherein serrations of said serrated edges are directed towards an edge of the stationary blade to enhance gripping of said material bodies.

13. A cutting mill according to claim 1, wherein the cylinder of the rotor is flattened between neighbouring knives of every cutting element group and is there provided with ribs.

14. A cutting mill according to claim, wherein bores in the sieve provide both on the side facing the rotor and on the side directed away from the rotor widened portions for gripping.

* * * * *

UNITED STATES PATENT AND TRADEMARK OFFICE

CERTIFICATE OF CORRECTION

PATENT NO. : 4,545,539

DATED : October 8, 1985

INVENTOR(S) : Bjarne T. Steffensen

It is certified that error appears in the above-identified patent and that said Letters Patent is hereby corrected as shown below:

In the title page of the patent, in the first column, after section [76], please insert the following:

--Assignee: Colortronic Reinhard & Co. KG, Friedrichsdorf, West Germany--

Signed and Sealed this

*Eleventh* Day of *March 1986*

[SEAL]

*Attest:*

*Attesting Officer*

DONALD J. QUIGG

*Commissioner of Patents and Trademarks*